United States Patent [19]

Weber et al.

[11] 4,302,430

[45] Nov. 24, 1981

[54] PROCESS FOR RELEASING AMMONIA BOUND IN COAL WATER

[75] Inventors: Heinrich Weber; Dieter Laufhutte, both of Recklinghausen, Fed. Rep. of Germany

[73] Assignee: Firma Carl Still GmbH & Co. KG, Fed. Rep. of Germany

[21] Appl. No.: 144,038

[22] Filed: Apr. 28, 1980

[30] Foreign Application Priority Data

May 3, 1979 [DE] Fed. Rep. of Germany ..... 2917780

[51] Int. Cl.[3] ..... C01C 1/10

[52] U.S. Cl. ..... 423/234; 423/238; 423/356

[58] Field of Search ..... 423/220, 234, 238, 356; 55/70, 73

[56] References Cited

U.S. PATENT DOCUMENTS

| | | | |
|---|---|---|---|
| 3,556,721 | 1/1971 | Radusch | 423/220 X |
| 3,789,105 | 1/1974 | Tippmer et al. | 423/238 X |
| 4,150,958 | 4/1979 | Jablin | 55/70 |

FOREIGN PATENT DOCUMENTS

| | | | |
|---|---|---|---|
| 2734497 | 2/1979 | Fed. Rep. of Germany | 423/220 |

*Primary Examiner*—G. O. Peters
*Attorney, Agent, or Firm*—McGlew and Tuttle

[57] ABSTRACT

A process for releasing ammonia which is bound in coal water using a pre-desulfurization plant having ammonia and hydrogen sulfide scrubbers through which crude coking plant gas is passed comprises circulating the crude coke oven gases through the hydrogen sulfide scrubber and the ammonia scrubber in succession, directing the coal water first through the ammonia scrubber while the crude coking plant gases are being also circulated therethrough after passing it first through the hydrogen sulfide scrubber. An alkali solution is also circulated through the ammonia scrubber to enrich the solution with acid components and to liberate ammonia bound in the coal water directing the coal water which has been enriched from the ammonia scrubber into the hydrogen sulfide scrubber. The process is characterized by the fact that the alkali solution which has first served for the hydrogen sulfide scrubber is added to the ammonia hydrogen sulfide scrubber. 80 to 90% of the total alkali solution is charged to the hydrogen sulfide after-washery and then on the hydrogen sulfide pre-washery and the rest is charged to an ammonia expulsion apparatus.

5 Claims, 1 Drawing Figure

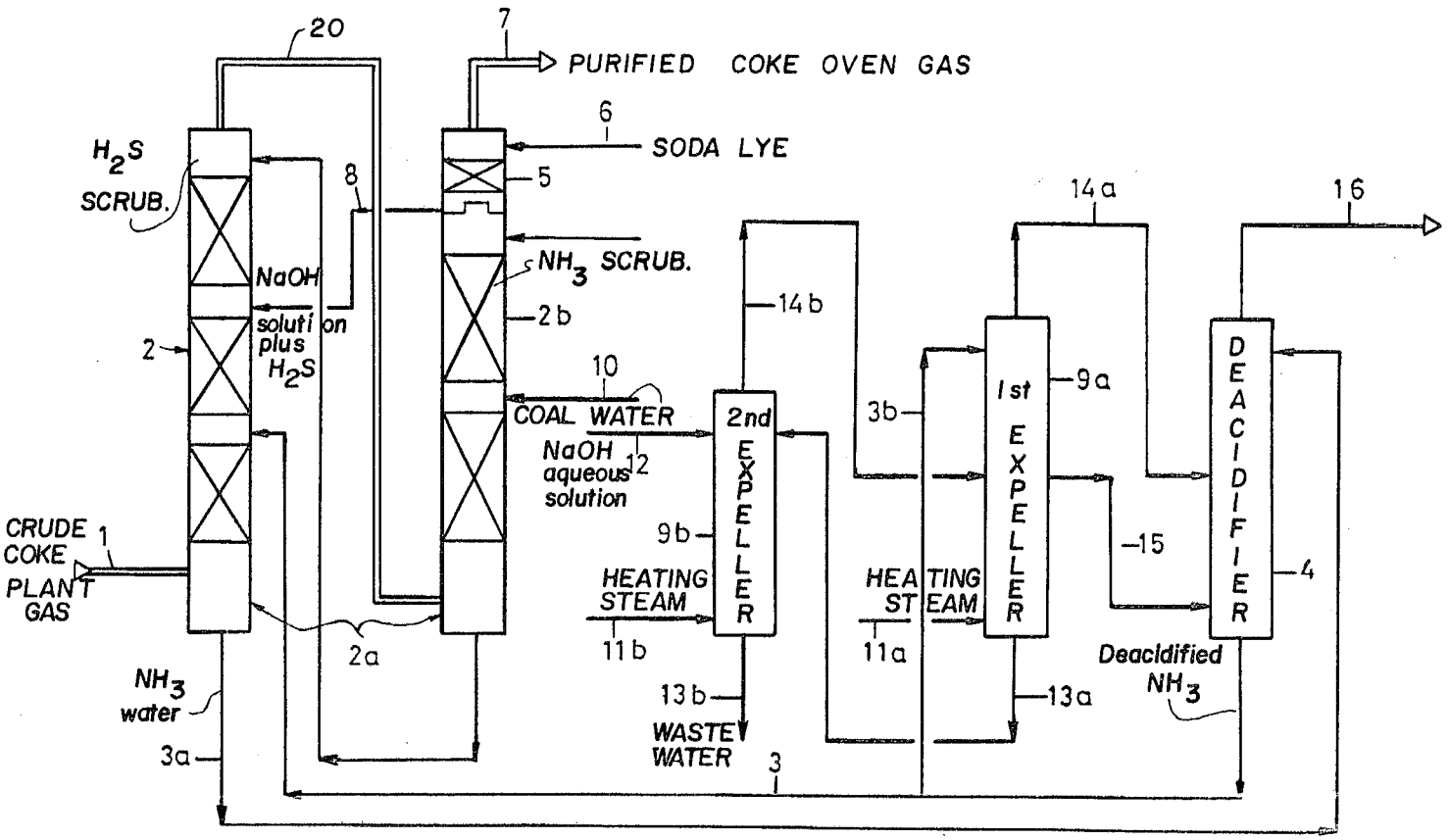
PURIFIED COKE OVEN GAS
SODA LYE
$NH_3$ SCRUB.
COAL WATER
NaOH aqueous solution
HEATING STEAM
WASTE WATER
DEACIDIFIER
Deacidified $NH_3$
1st EXPELLER
2nd EXPELLER
HEATING STEAM
NaOH solution plus $H_2S$
$H_2S$ SCRUB.
CRUDE COKE PLANT GAS
$NH_3$ water
1
2
2a
2b
3
3a
3b
4
5
6
7
8
9a
9b
10
11a
11b
12
13a
13b
14a
14b
15
16
20

PROCESS FOR RELEASING AMMONIA BOUND IN COAL WATER

FIELD AND BACKGROUND OF THE INVENTION

The invention relates in general to the coking of coal and in particular to a new and useful process for releasing the ammonia bound in coal water, the coal water being used, in ammonia-hydrogen sulfide cycle washers provided with deacidification and ammonia expulsion, for crude coking plant gas so as to wash out the ammonia. The acid components remaining in the coking plant gas after prewashing are retreated with alkali solution in an afterwasher, and the alkali solution enriched with acid components are drawn off from the alkali washing and used for releasing ammonia bound in the coal water and replaced by fresh alkali solution.

Known is a process for expelling bound ammonia from aqueous liquids, in particular from the aqueous condensates of low-temperature carbonization and coking of coal and lignite, bituminous shale and peat, as well as from the effluents of the processing of low-temperature carbonization or coking gases, in which the ammonia is bound to slightly volatile, strong acids, the aqueous liquids being mixed with aqueous solutions or suspensions of sulfidic alkaline substances which had served for the absorption of hydrogen sulfide from gases of low-temperature carbonization or coking. The mixture is subsequently heated when, as aqueous alkaline solutions are used, those sodium, potassium and lithium waste liquors which had been used for $H_2S$ scrubbing prepurified coke or low-temperature carbonization gases. In particular, in this process uses waste liquors which were employed in a hydrogen sulfide after-washery following the ammonia-hydrogen sulfide cycle washery. (DE OS No. 2,537,640).

A process is also known for expelling fixed ammonia from gas liquors where the service water leaving the ammonia scrubber is combined in the installation for expelling the ammonia with the cold stream of the wash liquid branched off from the cycle of the hydrogen sulfide scrubber, fresh soda or potash lye being continuously supplied to the wash liquid cycle of the hydrogen sulfide water and saturated washing agent liquid removed, using as starting solution in the hdyrogen sulfide scrubber a 3.0 to 5.0% preferably 3.5% soda lye, whose addition to the hydrogen sulfide scrubber can be regulated via a valve that through a colorimeter installed in the effluent stream of the ammonia expeller. A partial stream of the wash liquid cycle is so controlled as to quantity that all fixed ammonium salts are decomposed (DE OS No.2,734,495). Here the sodium sulfide-containing partial stream of the service water taken out of the ammonia scrubber, or from the gas cooler, can be added even before the ammonia expeller but preferably before the suction pump.

Further a process for expelling bound ammonia from ammonia-water in an ammonia expeller column is known, where a sodium sulfide liquor is added to the ammonia-water as strong base (DE PS No. 2,412,026).

Lastly, a process for the purification of coke oven gas is known, where from the detarred and cooled crude gas the ammonia is washed out with water, possibly with addition of sulfuric acid, and the hydrogen sulfide is washed out through a scrubbing cycle containing sodium or potassium carbonate, whence the hydrogen sulfide is expelled by means of carbon dioxide and to which certain quantities of soda or potash lye are continuously supplied and corresponding quantities of wash liquid removed, and wherein the wash liquid removed from the cycle of the hydrogen sulfide scrubber is admixed to the waste water of the ammonia scrubber for expulsion of the fixed ammonia present therein (DE AS No. 2,585,959).

In the processes known until now, the quantity of alkali necessary for the release of the bound ammonia contained in the coal liquors or, respectively, in the condensates, is used in a preceding scrubbing process to wash out the hydrogen sulfide as well as other acid components from the crude coke oven gas. Thereafter it is sent to the ammonia expeller or fed into the inflow line to the expeller, where it converts, the so-called fixed ammonium salts, and liberates the ammonia bound therein. For the complete conversion of the ammonium salts of the coal water one needs, as experience has shown, an excess of these desulfurization liquors. During the preceding desulfurization there is absorbed from the coke oven gas by the alkali solution besides hydrogen sulfide also a considerable proportion of hydrogen cyanide and carbon dioxide. Now if, in the expeller, an excess of this spent alkali liquor is added, the complete conversion and expulsion of the ammonia from the ammonium salts can indeed be achieved. Besides the carbon dioxide, however, there remains a considerable proportion of harmful hydrogen cyanide and also hydrogen sulfide bound to alkali in the waste water, thereby impairing its quality, so that herein an improvement is strived for.

In addition, one strives for an improvement of the hydrogen sulfide extraction in the known ammonia-hydrogen sulfide scrubber cycle, so that after the alkali after-scrubber a low hydrogen sulfide end content is obtained in the purified gas. Such an increase of the degree of extraction of hydrogen sulfide would be possible if one could increase the ammonia supply in the hydrogen sulfide scrubber of the ammonia-hydrogen sulfide scrubber cycle. This, however, should be effected without substantial extra expenditure for materials and energy, so as not to burden the profitability of the process.

SUMMARY OF THE INVENTION

The invention provides a means for reducing the proportion of harmful alkali cyanide and alkali sulfur compounds in coking plant effluent, as well as reducing the alkali quantity to be employed as a whole and, without substantial extra expenditure for apparatus and materials, increasing the ammonia supply in the hydrogen sulfide scrubber of an ammonia-hydrogen sulfide cycle scrubber.

For solving this problem, it has been proposed in accordance with the invention that the alkali solution which has been used for hydrogen sulfide after-scrubbing be added, not as in known processes to the ammonia expulsion or to the inflow to the ammonia expulsion, but to the ammonia hydrogen sulfide scrubber.

The alkali solution, saturated with hydrogen sulfide, hydrogen cyanide and carbon dioxide, combines in the hydrogen sulfide scrubber of the ammonia-hydrogen sulfide cycle scrubber with the coal water added in the ammonia scrubber which contains fixed ammonium salts, e.g. ammonium chloride, and there occurs the conversion of the fixed ammonium salts to volatile ones. Although only a slight amount of free alkali, and mainly alkali bound to $H_2S$, HCN and $CO_2$, enters in the extraction equilibrium between gas and wash liquid, it has been found, surprisingly, that according to the invention the hydrogen sulfide extraction effect is considerably improved.

It has proved especially effective to charge the greater proportion, say 80–90% of the alkali solution to be added as a whole in the hydrogen sulfide after-scrubber and the rest on the ammonia expulsion.

Of importance is also the point at which the alkali solution enriched with acid components is added to the hydrogen sulfide ammonia scrubber.

For reasons of the extraction equilibria, it is advantageous to locate the point of addition between the inflow from the ammonia scrubber and the inflow from the deacidifier.

While in the known processes a complete release of the bound ammonia from the wash waters is achieved only when using alkali excesses of 10 to 20 mol %, according to the invention, an excess of at most 5 mol % is sufficient.

It is possible, e.g., to reduce the $H_2S$ content of the gas issuing from the ammonia-hydrogen sulfide cycle scrubber from 1200 to 300–700 mg per $Nm^3$ and that of the rewashed final gas from 120 mg to 50 mg per $Nm^3$ and this without expenditure of additional materials and energy.

According to the invention, e.g. soda lye is charged on the last step of a coke oven gas desulfurization plant and the wash liquor enriched with hydrogen sulfide, carbon dioxide and hydrogen cyanide supplied to the ammonia desulfurization system placed upstream in the gas path. The coal water formed in the coal distillation, which contains the bound ammonia in the form of salts of strong acids, e.g. hydrochloric acid, is likewise employed in this cycle scrubber, namely for the ammonia elution, and charged into the ammonia scrubber.

The excess water from the coke oven gas desulfurization is charged in known processes on an ammonia expeller. But according to the invention, for the conversion of residual ammonium salts still contained in this excess water, only little fresh alkali solution is charged on the expeller in the lower or middle region.

A further improvement of the waste water quality is achieved if the ammonia water drawn from the wash cycle is transferred to a first expeller, and from it to a second expeller on which a smaller quantity of alkali solution is charged. Either both expellers may be steam-heated or only the second. The head vapors from the second expeller are then introduced into the first expeller approximately at mid height.

It is thereby achieved that with certainty the strong acids bound to ammonia in the cool water from the start are now completely bound to alkali and the ammonia is completely liberated, while all washer acids such as hydrogen sulfide and hydrogen cyanide are expelled from the water. The effluent corresponds in its quality to an effluent to which fresh alkali solution has been added in quantities equivalent to the ammonium salts.

Accordingly, it is an object of the invention to provide a process for releasing the ammonia bound in coal water, the coal water being used in an ammonia hydrogen sulfide cycle washery to wash out the ammonia, and acid components remaining in a coking plant gas after the cycle pre-washery and being extracted with alkali solution in an after-washery, the alkali solution being enriched with acid components being drawn off and used for liberating the ammonia bound in the coal water and replaced by a fresh alkali solution, and wherein the alkali solution which has served for the hydrogen sulfide after-washery is added to the ammonia hydrogen sulfide pre-washery.

A further object is to provide a process for releasing ammonia bound in coal water which is simple in concept and economical to carry out.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWINGS

The only FIGURE of the drawing is a schematic view of a plant for carrying out the process for releasing ammonia bound in coal water in accordance with the invention.

DESCRIPTION OF THE PREFERRED EMBODIMENT

Referring to the drawing, in particular, there is shown a plant for releasing ammonia bound in coal water and in which crude coking plant gas is circulated through an inlet 1 of a hydrogen sulfide scrubber and is then passed through a line 20 to an ammonia scrubber to purify the coke oven gas so that it may be discharged through a line 7 to atmosphere.

In a coking plant, 100,000 $Nm^3$ per hour of crude coke oven gas having a hydrogen sulfide content of 8 $g/m^3n$, is produced. The coking plant gas must be freed of both this hydrogen sulfide content and of ammonia, and the coking plant effluents must be freed of bound ammonia. To this end, the crude coking plant gas is supplied from line 1 (see diagram) at a temperature of 25° to 30° C. to the lower portion of the hydrogen sulfide scrubber 2 for coarse or pre-desulfurization. In the pre-desulfurization plant generally designated *2a*, which includes the hydrogen sulfide scrubber 2 and an ammonia scrubber *2b*, the raw or crude coking plant gas is desulfurized on the basis of an ammonia-hydrogen sulfide cycle wash of 90 $m^3/h$ of a 2.5% aqueous ammonical solution to a content of about 0.5 $g/m^3n$.

The ammonical water of the cycle washery enriched with $H_2S$ drains from the hydrogen sulfide scrubber 2 through line *3a*, and is pumped into the deacidifier 4 for regeneration, i.e. for expulsion of the acid components $H_2S$, $CO_2$ and HCN. The pre-purified coke oven gas passes through a line 20 to the lower end of the $NH_3$ scrubber and it rises from *2b* into the fine purifier 5 of the desulfurization plant *2a*. The fine purifier 5 receives through line 6, 10 $m^3$ per hour of soda lye containing 300 kg of sodium hydroxide NaOH. The finely purified coke oven gas issuing through line 7 contains less than 0.05 $g/l/m^3n$ $H_2S$. The sodium hydroxide solution enriched with $H_2S$, $CO_2$ and HCN, collects on the bottom of the fine purifier of 5. The solution, now containing only minor quantities of NaOH, is charged through line 8 to the lower portion of the hydrogen sulfide scrubber 2. Coal water is charged to the ammonia scrubber *2b* through a line 10 at a rate of 45 $m^3$ per hour. The coal water has a content of 3.5 g fixed ammonium salts per liter.

Deacidified ammonia water collects in the sump of the deacidifier 4, and through line 3 it is returned to the pre-desulfurization plant. The ammonia water cycle is thus closed.

Excess ammonia water is removed from the cycle and sent via line 3b to the first expeller 9a. The latter receives about 1.3 tons of heating steam per hour through line 11a. The outflow from expeller 9a is passed through line 13a to the second expeller 9b. The latter receives, through line 11b, 11.7 tons of heating steam per hour for expulsion and, through line 12, an aqueous solution of 70 kg NaOH per hour, to react residual ammonium salts still present in the water. From the sump of second expeller 9b there is drawn through line 13b, a waste water which only contains traces of ammonia and otherwise only the quantity of salt which corresponds to the formerly bound ammonia. All volatile compounds have passed over therefrom in the form of clouds of water vapor through the lines 14b into the expeller 9a and thence through the lines 14a and 15 into the deacidifier 4.

The steam quantities introduced through lines 11a and 11b and 9a and 9b are calculated so that therewith also the acid components of the ammonia water enriched in 2a and passed through 3a and 4 are driven off. At the head of 4, all volatile and volatilized components absorbed from the coke oven gas and the wash liquids, such as the originally free and bound ammonia, the $H_2S$, the carbon dioxide and the HCN, are drawn off through line 16 in the form of water vapors. These are processed in known manner, it being possible to isolate and to obtain the hydrogen sulfide and the ammonia in any known form. Also the ammonia may be burned up or decomposed by known methods. The effluent from line 13b contains only traces of $H_2S$ and HCN.

The total quantity of 370 kg NaOH (caustic soda) charged hourly on 5 and 9b corresponds stoichiometrically to the bound quantity of ammonia which was contained in the 45 $m^3$ coal water charged through line 10 on the $NH_3$ scrubber 2b.

If under otherwise constant conditions the total soda lye (370 kg NaOH) is charged on an expeller, there remain in the purified coke oven gas 150 mg $H_2S$ per $Nm^3$.

While a specific embodiment of the invention has been shown and described in detail to illustrate the application of the principles of the invention, it will be understood that the invention may be embodied otherwise without departing from such principles.

What is claimed is:

1. A process for releasing ammonia bound in coal water containing the ammonia in the form of salts of strong acids in an ammonia-hydrogen sulfide scrubbing process of a combined pre-desulfurization and ammonia removal plant having a hydrogen scrubber and an ammonia scrubber, the scrubbing process being of the type wherein raw coke oven gas containing ammonia and hydrogen sulfide is passed into the hydrogen scrubber, scrubbed with ammonical water received in the hydrogen scrubber from the ammonia scrubber to form a prepurified gas, and in which the prepurified gas is then passed into the ammonia scrubber and scrubbed with water to form the ammonical water to be used in the hydrogen scrubber, the improvement wherein the water passed in the ammonia scrubber is the coal water, and further comprising the steps of then passing the coal water into the hydrogen sulfide scrubber, scrubbing the prepurified gas in the ammonia scrubber with an aqueous alkali solution after the prepurified gas is scrubbed with the coal water to form an alkali solution enriched with acid components, and passing the enriched alkali solution into the hydrogen sulfide scrubber to liberate the ammonia bound in the coal water.

2. A process according to claim 1 wherein 80 to 90% of the total alkali solution is charged to the ammonia scrubber and then is passed through the hydrogen sulfide scrubber and further including directing the alkali solution to an expeller.

3. A process according to claim 2 including passing the aqueous alkali solution through at least one expeller and thence through a deacidifier and also collecting ammonia water from the scrubbers and directing it through the deacidifier, and collecting the deacidified ammonia and passing it back into the scrubber.

4. A process according to claim 3, wherein at least one expeller includes means for directing heating steam therethrough and including at least one additional expeller having means for directing heating steam therethrough, said alkali solution being passed through said second expeller and then only a portion thereof being passed through said first expeller.

5. A process according to claim 4 wherein soda lye is used as the alkali solution.

* * * * *